United States Patent [19]

Davis, Jr. et al.

[11] 4,445,339

[45] May 1, 1984

[54] WINGTIP VORTEX FLAME STABILIZER FOR GAS TURBINE COMBUSTOR FLAME HOLDER

[75] Inventors: Lewis B. Davis, Jr., Schenectady; Norman R. Dibelius, Ballston Spa, both of N.Y.

[73] Assignee: General Electric Co., Schenectady, N.Y.

[21] Appl. No.: 209,670

[22] Filed: Nov. 24, 1980

[51] Int. Cl.[3] ..... F02C 3/14

[52] U.S. Cl. ..... 60/749

[58] Field of Search ..... 60/749, 732, 733

[56] References Cited

U.S. PATENT DOCUMENTS

| | | | |
|---|---|---|---|
| 2,607,191 | 8/1952 | Lee | 60/749 |
| 2,935,847 | 5/1960 | Markowski | 60/749 |
| 2,938,344 | 5/1960 | Markowski | 60/749 |
| 2,974,488 | 3/1961 | Eggers et al. | 60/749 |
| 3,800,527 | 4/1974 | Marshall et al. | 60/749 |
| 3,921,391 | 11/1975 | Hall et al. | 60/749 |
| 3,934,409 | 1/1976 | Quillevere | 60/733 |
| 4,021,188 | 5/1977 | Yamagishi et al. | 60/732 |
| 4,054,028 | 10/1977 | Kawaguchi | 60/732 |

*Primary Examiner*—Louis J. Casaregola

*Attorney, Agent, or Firm*—J. C. Squillaro

[57] ABSTRACT

A flameholder arrangement for a gas turbine combustor or the like includes a primary flameholder such as an elongated V-gutter extending across a main flow stream of gaseous components within the combustor. Vortices are shed by the trailing edges of the primary V-gutter flameholder and circulate in essentially two-dimension flow fields in planes normal to the elongated V-gutter to produce a downstream wake. In addition, a plurality of winglets are carried by the primary flameholder and are configured so as to shed vortices rotating about axes generally parallel to the main flow stream. More particularly, the winglets are carried by the outer surfaces of the V-gutter elongated walls, and lie in planes normal to the V-gutter walls and angled with respect to the flow stream. The resultant flow in the wake downstream of the V-gutter is three-dimensional for enhanced mixing of the gaseous components. In particular, vigorous mixing is promoted as fresh mixture is brought from the surroundings into the recirculation zone for more uniform burning. The wingtip vortex stabilizer of the invention may be employed in a variety of specific applications where flame stabilization is required. One particular application disclosed herein is in the lean stage of a rich/lean two-stage combustor.

9 Claims, 7 Drawing Figures

WINGTIP VORTEX FLAME STABILIZER FOR GAS TURBINE COMBUSTOR FLAME HOLDER

BACKGROUND OF THE INVENTION

The present invention relates to flame holders, particularly for gas turbine combustors.

As is known, aerodynamic stabilization of the flame is necessary in most gas turbine combustors, as well as in jet engines, afterburners, and rocket engines, because the bulk velocity of the gaseous flow generally exceeds the turbulent flame speed. Without stabilization, a flame would otherwise blow downstream and be extinguished. In addition, mixing of the various gaseous components present in a combustor is generally effected by the turbulence associated with a flame holder. Such mixing is quite beneficial, and desirably should be enhanced for the reason that it improves the characteristics of the combustion reaction to limit pollutant emissions. Of particular concern has been the emissions of nitrogen oxides ($NO_x$), because such oxides are a precursor to air pollution. It is known that $NO_x$ formation increases with increasing flame temperature and with increasing residence time.

Flame stabilization is usually accomplished by employing devices such as swirlers, various kinds of bluff body flame holders, or by air jets. For example, an air swirler for a gas turbine combustor is disclosed in commonly-assigned Hopkins U.S. Pat. No. 3,630,024 and in commonly-assigned Hill et al U.S. Pat. No. 3,608,309.

One common device for stabilizing a flame, particularly in jet engine afterburners or augmentors is a "V-gutter". For example, V-gutter flameholders for afterburners are disclosed in the commonly-assigned Nerad et al U.S. Pat. No. 2,948,117, in the commonly-assigned Vdoviak U.S. Pat. No. 3,931,707, and in the commonly-assigned Nash U.S. Pat. No. 4,064,691, as well as in the Ernst U.S. Pat. No. 4,185,458. A typical V-gutter comprises a pair of elongated walls joined at a lineal vertex and diverging to respective trailing edges. The V-gutter extends across a main flow stream of gaseous components, and is oriented with the vertex pointed upstream. Flow across the V-gutter causes a recirculation region (wake) downstream of the V-gutter. The Nerad et al patent discloses a modified annular V-gutter flameholder having vortex generators mounted at spaced locations along the length of the modified V-gutter. The flameholders of the Voviak and Nash patents include both annular and radially-extending V-gutter flame holders within the same afterburner.

By way of further example, other forms of stabilization devices or swirlers are disclosed in the Lefebvre et al U.S. Pat. No. 4,134,260 and Egan, Jr. et al U.S. Pat. No. 4,170,109.

SUMMARY OF THE INVENTION

Accordingly, it is a primary object of the invention to enhance significantly the mixing in the wake behind a primary flameholder, for example a V-gutter.

In connection with the foregoing object, further objects of the invention are to achieve enhanced flame stabilization, rapid mixing of gaseous components and combustion products, and completing and quenching the combustion reaction in minimum time to limit the formation of $NO_x$ in a gas turbine combustor.

It is a more particular object of the invention, to provide an improved flameholder or stabilizer which can be used for the lean stage of a rich/lean two-stage combustor to achieve flame stabilization, as well as to achieve mixing of the hot, partially-burned product from the rich stage with additional air, thereby completing and quenching the combustion in minimum time to limit the formation of thermal $NO_x$ in the second stage.

Briefly stated, and in accordance with one aspect of the invention, a flameholder arrangement for a gas turbine combustor or the like includes a primary flameholder such as an elongated V-gutter extending across a main flow stream of gaseous components within the combustor. Vortices are shed by the trailing edges of the primary V-gutter flameholder and circulate in essentially two-dimensional flow fields in planes normal to the elongated V-gutter to produce a downstream wake. In addition, a plurality of winglets are carried by the primary flameholder and are configured so as to shed vortices rotating about axis generally parallel to the main flow stream. More particularly, the winglets are carried by the outer surfaces of the V-gutter elongated walls, and lie in planes normal to the V-gutter walls and angled with respect to the flow stream. The resultant flow in the wake downstream of the V-gutter is three-dimensional for enhanced mixing of the gaseous components. In particular, vigorous mixing is promoted as fresh mixture is brought from the surroundings into the recirculation zone for more uniform burning.

The wingtip vortex stabilizer may be employed in a variety of specific applications where flame stabilization is required, and may be applied to various flame-holding devices. Accordingly, it will be appreciated that the particular application illustrated and described herein in the context of the lean stage of a rich/lean two-stage combustor is exemplary only, and is not intended to limit the scope of the claimed invention. For example, additional fuel might be introduced upstream of the V-gutters with winglets through a set of spray bars. Also, the stabilizer can be used at the downstream end of premixers to ensure good mixing without allowing flashback. Additionally, the stabilizer of the present invention is potentially useful in a jet engine afterburner or augmentor.

BRIEF DESCRIPTION OF THE DRAWINGS

While the novel features of the invention are set forth with particularity in the appended claims, the invention, both as to organization and content, will be better understood and appreciated from the following detailed description, taken in conjunction with the drawings, in which:

DETAILED DESCRIPTION OF THE PREFERRED EMBODIMENTS

Figure 1:
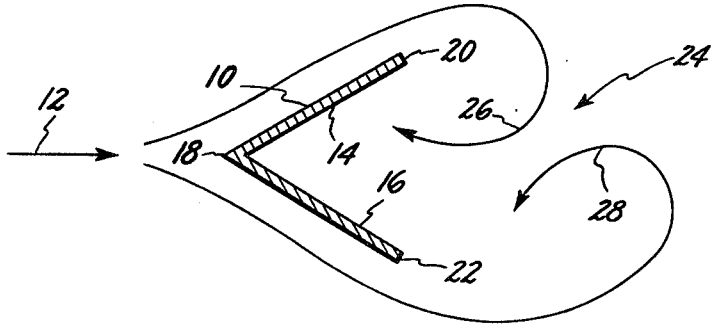
FIG. 1 (PRIOR ART)
FIG. 1 is a cross-sectional view of a typical prior art simple V-gutter flame holder, with arrows depicting the essentially two-dimensional recirculation region downstream of the V-gutter.

Referring now to the drawings wherein identical reference numerals denote similar or corresponding elements throughout the various views, in FIG. 1 a typical prior art simple V-gutter flame holder 10, shown in cross-section, extends across a main flow stream, depicted by an arrow 12, of gaseous components, such as occur within a gas turbine combustor. The V-gutter 10 comprises a pair of elongated walls 14 and 16 joined at a lineal vertex 18 and diverging to respective trailing edges 20 and 22.

Conventionally, the V-gutter 10 is oriented with the vertex 18 pointed upstream, and vortices are shed by the trailing edges 20 and 22 of the V-gutter 10 and circulate in essentially two-dimensional flow fields in planes normal to the elongated V-gutter 10 to produce a downstream wake 24 as depicted by the arrow lines 26 and 28. The flow field downstream of the FIG. 1 prior art V-gutter flame holder 10 is essentially two-dimensional as indicated.

Figure 2A:
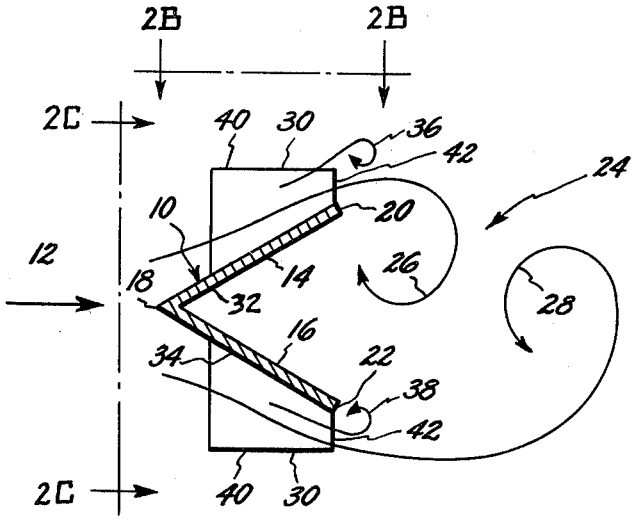
FIG. 2A is a view similar to FIG. 1, but additionally showing winglets supplied to the V-gutter in accordance with the present invention.
Figure 2B:
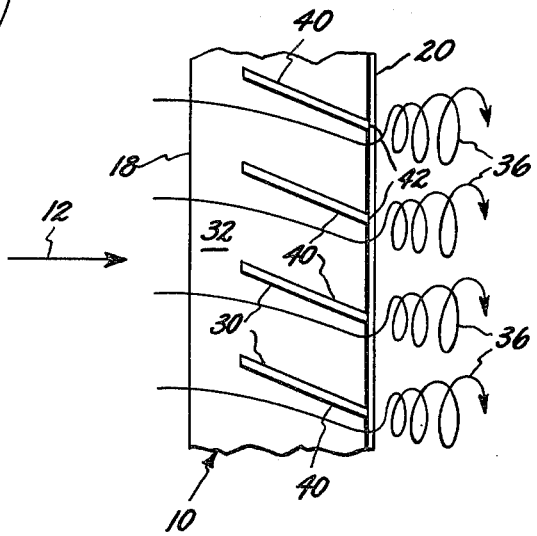
FIG. 2B is a plan view taken along line 2B—2B of FIG. 2A.
Figure 2C:
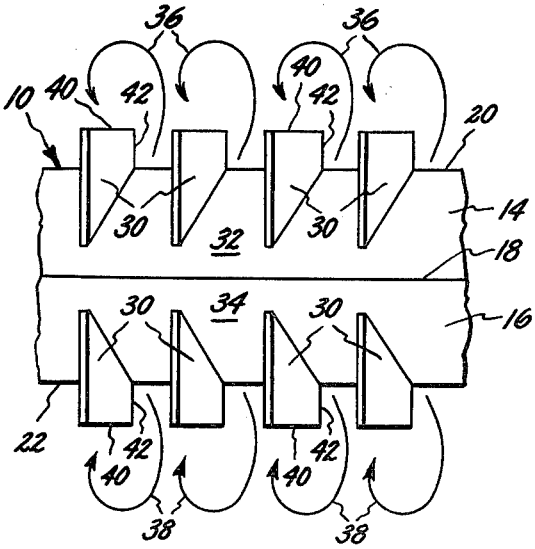
FIG. 2C is a front elevational view taken along line 2C—2C of FIG. 2A.

With reference now to FIGS. 2A, 2B and 2C, the present invention enhances significantly the mixing in the wake 24 behind the V-gutter 10 by making the flow three-dimensional. Specifically, a plurality of winglets 30 are carried by the outer surfaces 32 and 34 of the V-gutter 10 elongated walls 14 and 16. The winglets 30 are flat and preferably of the generally trapazoidal configuration shown. They are secured to the V-gutter 10 by conventional metal-joining techniques, such as welding, suitable for the particular environment.

The winglets 30 lie in planes normal to the V-gutter walls 14 and 16, and are angled with respect to the flow stream represented by the arrow 12. As depicted by the arrow lines 36 and 38, vortices are shed by the outer 40 and trailing 42 edges of the winglets 30, these vortices having predominant axes of rotation parallel to the axis of the main flow represented by the arrow 12.

These additional vortices shed by the winglets 30 promote vigorous mixing of components into the recirculation zone or wake 24 downstream of the V-gutter 10 for more uniform burning.

While it will be appreciated that the winglets 30 of the present invention might be applied to a wide variety of flameholders in a variety of particular applications, one specific application envisioned is in the lean stage of a rich/lean two-stage combustor.

Figure 3A:
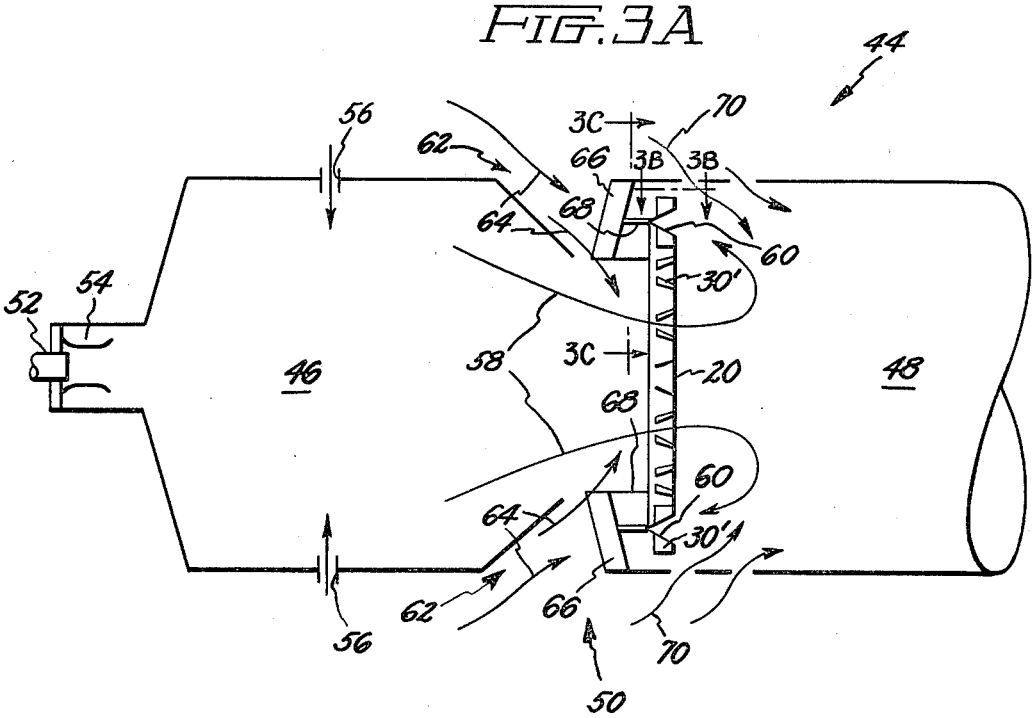
FIG. 3A is a highly schematic cross-sectional view of a gas turbine combustor including an annular flame stabilizer in accordance with the invention.

More specifically, and with particular reference to FIG. 3A, a gas turbine combustor 44 of generally cylindrical configuration comprises a first combustion zone or section in the form of a rich stage 46, and a second combustion zone or section in the form of a lean stage 48. A gas turbine combustor of this general configuration is disclosed in commonly-assigned Johnson et al U.S. patent application Ser. No. 948,630, filed Oct. 4, 1978, and entitled "HOUR-GLASS COMBUSTOR FOR LOW $NO_x$ EMISSIONS IN STATIONARY GAS TURBINES", the entire disclosure of which is hereby incorporated by reference.

More particularly, the rich stage 46 and the lean stage 48 are connected by a transition zone in the form of a neck or throat section 50, and all of the hydrocarbon fuel to be utilized by the combustor 44 is introduced into the rich stage 46 through a conventional fuel nozzle 52 and an associated swirl cup 54 disposed at an upstream portion of the rich stage 46. Air from the gas turbine compressor (not shown) is also introduced into the rich stage 46 under elevated pressure, typically in the order of 10–30 atmospheres. Preferably, part of the compressed air is introduced through air swirlers (not shown) located concentrically with the fuel nozzle 52 as a vortex in order to ensure flame stability. The remainder of the rich stage 46 compressed air may be introduced radially into the rich stage 46 through one or more air entry ports 56.

The rich stage 46 is operated on the fuel-rich side of stoichiometric, in the range of fuel/air equivalence ratios from above 1.1 to about 3.0. Preferably the fuel/air equivalence ratio in the rich stage 46 is about 1.2 to 2.2, and most preferably about 1.4 to 1.7. During the combustion process in the first stage 46, nitrogen from the fuel is released as nitrogen radicals or highly-reactive intermediate compounds. These compete with one another and other radicals and reactive species from the burning fuel for the available oxygen. Under the fuel-rich conditions employed, the production of nitrogen is favored over the production of nitrogen oxide. The richer the mixture, the less nitrogen oxide is produced. Conducting the combustion in the rich stage 46 with a limited amount of air also serves to keep the adiabatic flame temperature low, which further limits production of thermal $NO_x$.

Combustion gases comprising partially burned product exit the rich stage 46, as indicated by the arrow lines 58, at a high temperature generally in the neighborhood of 2800° F., and are composed mostly of gaseous hydrocarbon, carbon monoxide, carbon dioxide, water, nitrogen, small concentrations of other products including a minor amount of $NO_x$, and partially burned fuel. These combustion gases are conveyed through the neck section 50 into the lean stage 48.

As disclosed in the above-referenced commonlyassigned application Ser. No. 948,530, the neck or throat section 50 acts as an aerodynamic separator or isolator between the rich stage 46 and the lean stage 48. The neck section 50 also serves to accelerate the velocity of the combustion gases indicated by the arrow lines 58 entering the lean stage 48, thereby permitting more rapid mixing of the combustion gases with the air utilized for lean burning in the lean stage 48.

Within the lean stage 48 a second combustion is effected, aided by additional compressed air introduced. The amount of additional compressed air is sufficient to achieve a lean fuel admixture, i.e., an admixture having a fuel/air equivalence ratio of between 0.3 and 0.7, and preferably about 0.5 or less. In the overall general operation, the fuel/air equivalence ratio is converted from fuel-rich in the first zone 46 to fuel-lean in the second zone 48 in such a manner as to preclude a substantial amount of combustion at equivalence ratios close to unity (stoichiometric fuel/air ratio) where large amounts of $NO_x$ would be produced.

Figure 3B:
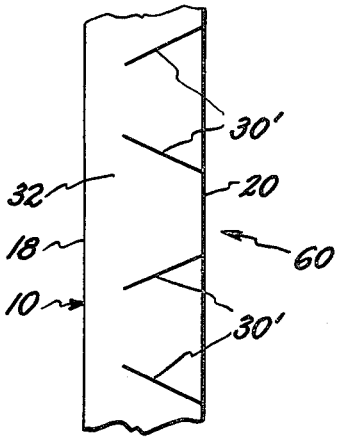
FIG. 3B, which may be generally compared with FIG. 2B, is a greatly-enlarged view taken along line 3B—3B of FIG. 3A showing an alternative configuration wherein the winglets are arranged at non-parallel angles to each other.
Figure 3C:
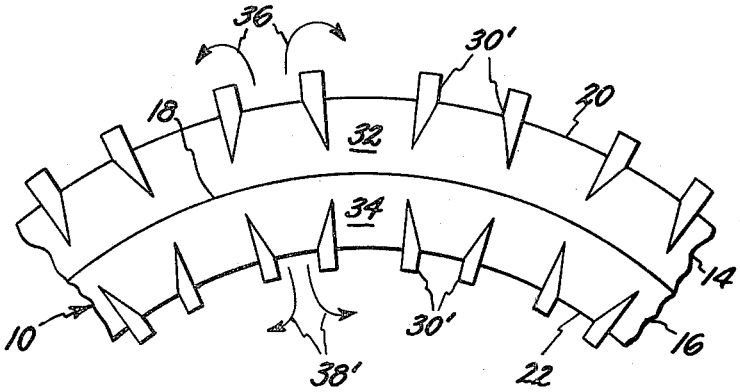
FIG. 3C, which may be compared with FIG. 2C, is a greatly enlarged view taken along line 3C—3C of FIG. 3A.

In accordance with the present invention, a wingtip vortex stabilizer generally designated 60 is arranged in annular configuration, and comprises a primary flameholder in the form of a curved elongated V-gutter to which winglets 30′ are applied. The general orientation of the annular stabilizer 60 of the invention is shown in FIG. 3A, while enlarged details are shown in FIGS. 3B and 3C. As in the embodiment of FIGS. 2A, 2B and 2C, the stabilizer 60, although curved rather than extending in a straight line, comprises a V-gutter 10 having the winglets 30' carried by the outer surfaces 32 and 34 of the V-gutter walls 14 and 16.

The annular stabilizer 60 is positioned within the lean stage 48 just downstream of inlets 62 for combustion and quenching air flow denoted by arrow lines 64. The stabilizer 60 is supported in position by means of periodically-spaced mechanical support elements 66 having extensions 68 supporting the V-gutter 10 near its vertex 18.

In operation, the hot gaseous mixture denoted by the arrow lines 58 flowing from the rich stage 46 is mixed with combustion and quenching air by the vortices generated by the stabilizer 60, particularly the primary V-gutter flame holder 10 and the winglets 30' thereof.

Additional combustion and quenching air may be admitted to the core of the rich stage products through holes ahead of and behind the stabilizer 60, as indicated by the additional arrow lines 70. The axial location of the various holes is important in order to allow sufficient time for the combustion reaction to take place, but not sufficient time for an appreciable quantity of $NO_x$ to form.

A number of variations may be applied to this basic arrangement. For example, the stoichiometry downstream of the stabilizer 60 can be adjusted by making the length of the winglets 30' on the radially inside surface 34 of the V-gutter 10 a different length or affixing them at a different angle from the winglets 30' on the radially outside surface 32 of the V-gutter 10. If necessary, the flow past the V-gutter 10 can be controlled by metering upstream of the stabilizer 60. Further, additional fuel may be introduced upstream of the stabilizer 60 through a set of spray bars.

FIGS. 3B and 3C, which may generally be compared with FIGS. 2B and 2C, additionally illustrate a variation in winglet orientation in accordance with the invention. Specifically, in FIGS. 2B and 2C the winglets 30 are oriented parallel with each other, although angled with respect to the flowstream represented by the arrow 12. In the alternative illustrated in FIGS. 3B and 3C, the winglets 30' are oriented at non-parallel angles to each other. As a result, the vortices shed by the trailing edges of the FIGS. 3B and 3C winglets 30' alternately rotate in opposite directions about the axes.

From the foregoing, it will be appreciated that by the present invention there has been provided a flame stabilizer which enhances significantly the mixing in the wake behind a primary flame holder, particularly a V-gutter flame holder, by making flow three-dimensional.

While specific embodiments of the invention have been illustrated and described herein, it is realized that modifications and changes will occur to those skilled in the art. It is therefore to be understood that the appended claims are intended to cover all such modifications and changes as fall within the true spirit and scope of the invention.

What is claimed is:

1. A flameholder arrangement for a gas turbine combustor or the like, said arrangement comprising:

a primary flameholder in the form of an elongated V-gutter extending across a main flow stream of gaseous components within the combustor, said V-gutter having a pair of elongated walls joined at a lineal vertex and diverging to respective trailing edges, and said V-gutter oriented with the vertex pointed upstream, said V-gutter being effective to shed first vortices from trailing edges of said V-gutter which circulate in essentially two-dimensional flow fields in planes normal to said elongated V-gutter to produce a downstream wake;

a plurality of winglets on outer surfaces of said V-gutter elongated walls;

said winglets being disposed at positions with respect to said trailing edges and at angles with respect to the main flow stream effective to shed second vortices rotating about axes generally parallel to the main flow stream; and said first and second vortices producing a three-dimensional resultant flow in the wake downstream of said V-gutter effective to enhance mixing of the gaseous components.

2. A flameholder arrangement according to claim 1, wherein said winglets lie in planes normal to said V-gutter walls.

3. A flameholder arrangement according to claim 1, wherein said winglets are oriented in parallel with each other.

4. A flameholder arrangement according to claim 1, wherein at least some of said winglets are oriented at non-parallel angles to others thereof.

5. A flameholder arrangement according to claim 2, wherein said winglets are oriented in parallel with each other.

6. A flameholder arrangement according to claim 2, wherein at least some of said winglets are oriented at non-parallel angles to others thereof.

7. A flameholder arrangement according to claim 1, wherein said elongated V-gutter is curved in annular configuration.

8. A flameholder arrangement for a gas turbine combustor or the like, said arrangement comprising:

an elongated primary flameholder in the form of an elongated V-gutter positioned within a main flow stream of gaseous components within the combustor and configured so as to produce a recirculation region in the form of vortices downstream of said primary flameholder, said primary flameholder being effective to shed first vortices from trailing edges of said V-gutter which circulate in essentially two-dimensional flow fields in planes normal to said V-gutter to produce a downstream wake;

a plurality of winglets on outer surfaces of said primary flameholder, said winglets being disposed at positions with respect to downstream edges of said primary flameholder and at angles with respect to said main flow stream effective to shed second vortices rotating about axes generally parallel to the main flow stream; and said first and second vortices producing a three-dimensional resultant flow in the wake downstream of said primary flameholder effective to mix the gaseous components.

9. A rich/lean two-stage combustor for a stationary gas turbine, said combustor comprising:

a rich stage including a first combustion zone into which fuel and air are introduced;

a lean stage including a second combustion zone connected to receive combustion gases from said rich stage, and including inlets for combustion and quenching air;

a stabilizer within said lean stage for enhanced flame stabilization and mixing of gaseous components;

said stabilizer including a primary flameholder in the form of an elongated V-gutter curved in annular configuration, said V-gutter having a pair of elongated walls joined at a lineal vertex and diverging to respective trailing edges, said V-gutter being oriented with the vertex pointed upstream, said V-gutter being effective to shed first vortices from the trailing edges of said V-gutter which circulate in essentially two-dimensional flow fields in planes normal to said elongated V-gutter to produce a downstream wake;

a plurality of winglets on outer surfaces of said V-gutter elongated walls;

said winglets being disposed at positions with respect to said trailing edges and at angles with respect to the main flow stream effective to shed second vortices rotating about axes generally parallel to the main flow stream; and said first and second vortices producing a three-dimensional resultant flow in the wake downstream of said V-gutter for enhanced mixing of the gaseous components.

* * * * *